United States Patent [19]

Hardenbrook

[11] 4,149,486

[45] Apr. 17, 1979

[54] TRANSFER DEVELOPMENT APPARATUS USING SELF-SPACING DONOR MEMBER

[75] Inventor: James M. Hardenbrook, Columbus, Ohio

[73] Assignee: Xerox Corporation, Stamford, Conn.

[21] Appl. No.: 770,172

[22] Filed: Feb. 16, 1977

Related U.S. Application Data

[63] Continuation of Ser. No. 545,272, Jan. 30, 1975, abandoned.

[51] Int. Cl.[2] ..... G03G 15/08

[52] U.S. Cl. ..... 118/653; 118/651

[58] Field of Search ..... 118/650, 644, 653, 656, 118/661, 651; 355/3 DD; 427/21, 24, 25; 96/1 LY, 1 TE

[56] References Cited

U.S. PATENT DOCUMENTS

| | | | |
|---|---|---|---|
| 2,892,709 | 6/1959 | Mayer | 118/651 X |
| 2,895,847 | 7/1959 | Mayo | 118/653 |
| 3,115,814 | 12/1963 | Kapnelian | 118/653 |
| 3,203,394 | 8/1965 | Hope et al. | 118/650 |
| 3,375,806 | 4/1968 | Nost | 118/653 |
| 3,519,819 | 7/1970 | Gramza et al. | 96/1 TE |
| 3,559,570 | 7/1966 | Mantel et al. | 118/661 |
| 3,676,215 | 7/1972 | Gundlach | 96/1 LY |
| 3,739,748 | 6/1973 | Rittler et al. | 118/653 |
| 3,860,436 | 1/1975 | Meagher | 118/651 X |
| 3,866,572 | 2/1975 | Gundlach | 118/651 |
| 4,023,967 | 5/1977 | McGibbon | 118/661 X |

*Primary Examiner*—Werner H. Schroeder
*Assistant Examiner*—Andrew M. Falik
*Attorney, Agent, or Firm*—James J. Ralabate; William A. Henry, II

[57] ABSTRACT

In an electrostatographic imaging apparatus, comprising, an imaging member with a surface capable of retaining an electrostatic latent image, a donor member with a surface capable of supporting a layer of particulate image-developing material, and means for maintaining the surface of said donor member in close proximity to the surface of said imaging member, the improvement which comprises a donor member having permanently disposed on its surface a plurality of raised, granular elements for self-spacing the donor member from the imaging member.

1 Claim, 7 Drawing Figures

TRANSFER DEVELOPMENT APPARATUS USING SELF-SPACING DONOR MEMBER

This is a continuation, of application Serial No. 545,272, filed Jan. 30, 1975 now abandoned.

BACKGROUND OF THE INVENTION

The present invention is related to xerographic copying systems and, more particularly, to systems which employ what is known as "transfer" or "touchdown" development.

The xerographic process as disclosed in Carlson's patent U.S. Pat. No. 2,297,691, encompasses a xerographic plate comprising a layer of photoconductive insulating material on a conductive backing. This plate is provided with a uniform electric charge over its surface and is then light exposed to the subject matter to be reproduced. The light exposure discharges the plate areas in accordance with the radiation intensity that reaches it and thereby creates a latent electrostatically charged image on or in the photoconductive layer. Development of the latent image is effected with an electrostatically charged, finely divided material, such as an electroscopic powder, that is brought into surface contact with the photoconductive layer and is held thereon electrostatically in a selective pattern corresponding to the latent electrostatic image. Thereafter, the developed image may be fixed by any suitable means to the surface on which it has been developed or the developed image may be transferred to a secondary support surface to which it may be fixed or utilized by means known in the art.

Once the electrostatic latent image is formed, the method by which it is made visible is the developing process. Various developing systems are well known in the art and include cascade, brush development, magnetic brush, powder cloud and liquid development. Still another developing method is disclosed in Mayo patent U.S. Pat. No. 2,895,847 in which a developer support member, called a "donor," is employed to present a releasable layer of electroscopic (toner) particles to the photoconductive layer for deposit thereon in conformity with the electrostatic latent image. The Mayo approach is one of several variations which involve the transfer of toner particles from a donor to the photoconductive surface and is therefore called transfer development. This technique is also known as "touchdown development."

The three principal variations of transfer development include (1) an arrangement in which the layer of toner on the donor surface is held out of contact with the electrostatically imaged photoconductor and the toner must traverse an air gap to effect development; (2) an arrangement in which the toner layer on the donor is brought into rolling contact with the imaged photoconductor; and (3) an arrangement in which the toner layer is brought into contact with the imaged photoconductor and skidded across the imaged surface to effect development.

In the first of the above arrangements where the toner and photoconductor surface are maintained out of contact, a layer of toner particles is applied to a donor member which is capable of retaining the particles on its surface and then the donor member is brought into close proximity to the surface of the photoconductor. In this closely spaced position, particles of toner in the toner layer on the donor member are attracted to the photoconductor by the electrostatic charge on the photoconductor so that development can occur. Typically, the spacing between donor and photoconductor is between 1 and 10 mils. This arrangement is referred to as "spaced touchdown development."

In touchdown development, a variety of donor is possible and known in the art. A donor member may be constructed of a variety of materials which includes paper, plastic, cloth, metal, aluminum foil or metal-backed paper.

In U.S. Pat. No. 3,203,394 to Hope et al., various donors are described which employ the principle of using a set of conductive posts or a conductive screen which is charged in the same polarity and selective amount as the charged toner particles. Accordingly, as the donor member is brought into contact with the toner particles, those areas adjacent to the posts or screen will electrostatically repel the toner, thereby forcing the toner away from those portions. The remaining areas of the donor member are charged to attract the toner particles and the particles accumulated there. As described in the Hope et al. patent, a donor member of this type of construction provides better mobility to the toner particles so as to yield sharper xerographic copies.

In U.S. Pat. No. 3,375,806 to Nost, the donor member is described as being either electrically insulative or conductive and may comprise such materials as metal sheets, conductive rubbers, Mylar or the like.

Although spaced touchdown may be used with a variety of donor as discussed above, certain problems exist in this approach. One of the problems of the spaced donor arrangement is the difficulty of maintaining the aforementioned spaced relationship between the donor surface and the photoconductive surface. Additionally, in all transfer development systems, uniform deposition of toner onto the donor, which is a requirement for high quality prints, has been difficult to achieve because of the tendency of toner to clump and because of the internal electrostatic forces among the toner particles.

One approach for obviating the above problems has been the use of a donor member having a surface with raised and depressed portions, such as a gravure surface with an elevated grid network enclosing a plurality of depressed cups, as disclosed in Greig, U.S. Pat. No. 2,811,465. If such a donor member were used in contact with the imaging surface and doctored such that toner resided only in the cups, theoretically the toner would not contact the background, or uncharged, areas of the imaging surface. That is, the uniform gap between toner and image could be maintained by having the raised areas of the donor as the only point of contact on the imaging surface. Toner would, of course, still be attracted from the depressed portions of the donor to the charged, imaged areas, but the need for complicated, gap-controlling means would be eliminated. Additionally, the roughened surface would tend to break up clumps of toner during the loading step.

However, in practice, although such a donor member produced somewhat improved transfer development, it was found that toner could not be efficiently loaded on the donor without at least partially covering the raised grid structure with toner. Thus, toner was still contacting background areas of the imaging surface, thereby producing some background deposition in the copy. Also, the images produced bore the impression of the grid structure due to interference of the grid with complete toner deposition on the charged areas. Clearly, both the above results are undesirable in a high-quality imaging process.

SUMMARY OF THE INVENTION

It is accordingly an object of the present invention to provide an electrostatographic copying method employing touchdown development with improved means for achieving self-spacing between the donor surface and the imaging surface.

It is a further object of the present invention to provide an improved method for laying down a uniform layer of toner on a donor surface.

The above objects and other advantages are realized by providing, in a xerographic transfer development apparatus for example, a developer donor member having disposed on its surface a plurality of raised, granular self-spacing elements in an amount sufficient to maintain a uniform gap between the floor of the donor surface and the imaging surface when they are in contact. The preferred method of this invention employs a donor having granular, bead-like elements on its surface as the spacing means with regions therebetween capable of holding developer or toner particles in a noncompacted state as it is brought into contact with the imaging surface.

The spacing means are believed to serve three important functions:

1. They serve a metering function to control toner layer thickness during the doctoring process;
2. In the doctoring process they break up loose clumps of toner of the type present in any mass of small particles; and
3. They prevent pressure and reduce contact of the toner against the photoreceptor to the extent that background deposits are virtually eliminated.

DETAILED DESCRIPTION OF THE INVENTION

Figure 1:
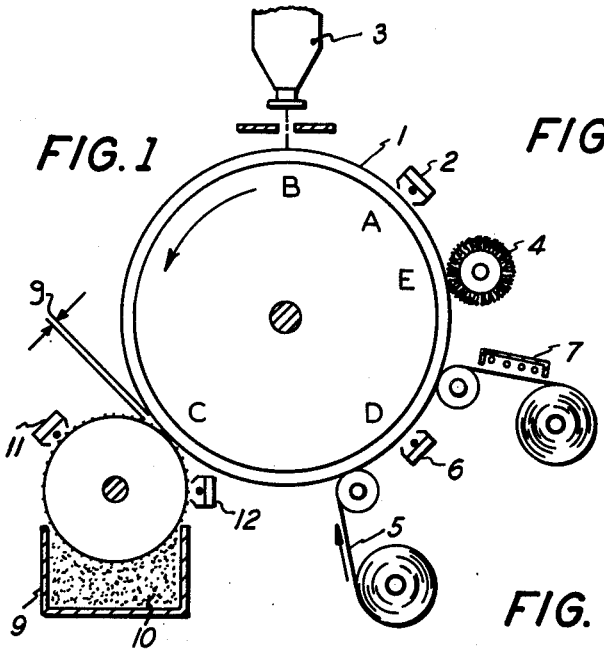
FIG. 1 illustrates schematically a simplified form of a spaced touchdown xerographic system.

Referring initially to FIG. 1, shown there is a xerographic reproduction system compatible with the present invention. The system comprises a xerographic photoconductive plate in the form of drum 1. The drum is driven by conventional means which rotates the surface through stations A–E as indicated in the figure. The drum has a suitable photosensitive surface, which may, for example, include selenium overlying a layer of conductive material, upon which a latent electrostatic image can be formed. The various stations about the periphery of the drum are the charging station A, exposing station B, developing station C, transfer station D and cleaning station E. At the charging station A, a suitable charging means 2, such as a corotron, places a uniform electrostatic charge on the photoconductive surface. As the drum rotates, the charged area is brought to station B where a suitable exposing device 3 supplies the light image to be reproduced. A latent electrostatic image is thus formed on the surface of the drum. This image is then developed at station C by the application of a finely divided, pigmented, resinous, electroscopic powder called toner. The developed image then passes through transfer station D which includes the copy sheet 5, corona charging device 6 and fusing element 7. The last station E performs the function of cleaning the surface such as with the use of brush 4 or any other suitable conventional device.

Referring particularly to the developing station C of FIG. 1, a donor member 8 is shown which is preferably rotatable by conventional means (not shown) in the direction indicated. Adjacent donor member 8 is a toner reservoir 9 containing toner particles 10. The donor member or roll 8 is positioned so that a portion of its periphery comes into contact with toner 10. Also located around the donor roll 8 are charging means 11 and 12. Charging means 11, which may be a corona charging device, is adapted to place a uniform charge on the toner particles of a polarity opposite to the polarity of the latent image on the photoconductive drum. Charging means 12, also a corona charging device, is for neutralizing the donor to aid in the removal of residual toner by an appropriate cleaning means (not shown).

In this arrangement, the surface of donor member 8 has a granular material fixed to it so as to provide a small gap "g" as shown in FIG. 1 which can be approximately one to several mils. This gap may be filled or partially filled with electroscopic toner particles. In accordance with the present invention, this gap is maintained in a self-spacing manner as described below.

Figure 2A:
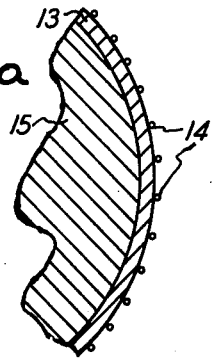
FIGS. 2*a* and 2*b* illustrate, in a side sectional view, arrangements of a donor surface with spacing particles adhering thereto in accordance with the present invention.

In FIG. 2*a*, the cross-section of a donor member is shown. In the figure, an electrically conductive layer or member 13, is affixed to a flexible backing element 15. The conductive layer 13 may be aluminum, for example. In FIG. 2*a*, the self-spacing elements 14 are permanently affixed directly to the conductive layer.

It is preferred that each of the self-spacing elements 14 define essentially as close to a point contact as possible with the photoconductive surface 1. Accordingly, the self-spacing elements 14 are preferably rounded or beadshaped. Satisfactory compositions for such beads are glass, Ottawa sand, metal or plastic, or combinations thereof. The beads should be of a relatively uniform diameter. A preferred diameter of the beads is 2 to 3 mils. The beads may be permanently affixed to the donor surface by the use of epoxy or any other adhesive. To permit usage of a batch of beads which is not monosized, a planar top may be provided to the field of beads. This may be accomplished by first adhering the beads temporarily to a first surface, creating the uniform plane, then permanently bonding the beads to a second surface and removing the first surface.

Regardless of the exact configuration of the granular spacing elements, they must be present in a density sufficient to maintain a uniform gap between the floor of the donor surface and the imaging surface as the donor rides in contact with the imaging surface. Thus, for example, for beads of diameter 2 to 3 mils, a preferred density range is from about 20 to 60 beads per square millimeter. It is preferred, but not absolutely necessary, that a relatively uniform spacing be maintained between individual beads on the donor surface.

It is preferred that the operating layer of the donor be disposed on a flexible backing element 15 as shown in FIG. 2*a*. This is desirable to insure that the beads do not damage the photosensitive surface of the drum by pressure from the donor. A number of approaches for achieving a flexible or semi-flexible donor member will suggest themselves to those skilled in the art.

Figure 2B:
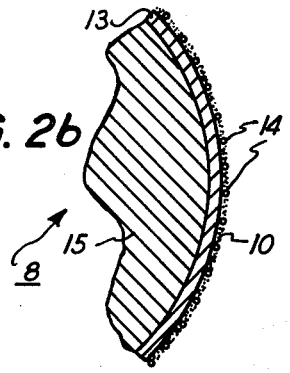

FIG. 2*b* represents the donor member in which the spaces between the spacing elements 14 are filled with toner material and the donor member is in condition to perform its development functions when brought into developing relationship with a surface bearing an electrostatic image.

Figure 3:
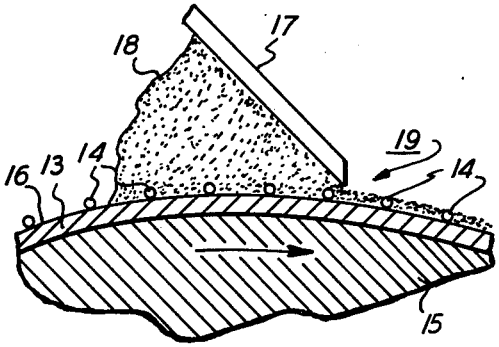
FIG. 3 illustrates one embodiment for forming an even layer of toner between spacing particles.

FIG. 3 shows a section of the donor member in which a doctor blade 17 which may be of a rigid or semirigid material such as steel, plastic or a vulcanized elastomer is used to distribute toner from a toner supply 18 between spacer element 14 to form toner layer 19 on donor element surface 16. The doctor blade may be edged in any suitable fashion at the points of contact with the spacing elements. If the blade tip is pointed, as shown in FIG. 3, the array of the element 14 should be geometrically random enough across the donor surface that the blade will not dip between elements and thus form concavities in the toner layer. The blade tip may also be bevelled parallel to the donor surface, in which event the bevel width of the blade will in most instances span the elements sufficiently to prevent dipping into the toner.

Figure 4:
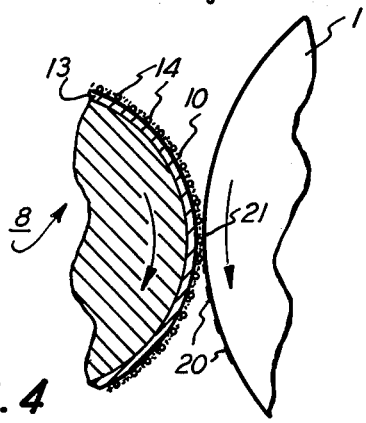
FIG. 4 illustrates the donor in self-spacing contact with the imaging surface during the development mode of this invention.

Referring to FIG. 4, cylindrical donor 8 is shown in development contact with xerographic drum 1 bearing an electrostatic latent image on its surface. The donor 8 rides on drum 1 by means of the contact of spacing elements 14 on the drum surface, as at contact point 21. It will be seen that, in this manner, the donor surface itself is kept from contact with the drum surface so that the toner layer 19 can be retained between spacing elements 14 in a non-compacted state. Also, if the toner layer thickness is kept at or below the average height of the elements 14 above the donor surface, little or no toner will contact the drum 1 in uncharged or background regions, thus substantially preventing toner deposits in nonimage areas of the drum. Preferably, a suppressing bias is applied to the donor surface, of the same polarity as that of the latent image, and of course opposite that of the toner. This bias should be considerably smaller than the magnitude of the latent image charge. Thus, toner will tend not to be attracted to background areas, and will still be attracted by the much greater image charge to develop it adequately.

Drum 1 and donor 8 are shown in opposite rotation. As the donor 8 encounters the electrostatically-imaged areas, toner is selectively attracted to the drum and deposits thereon as the developed image 20.

EXAMPLE

A flat plate, self-spacing donor was prepared by generating an aerosol of glass beads of 52 to 74 microns diameter, and electrostatically driving them against a 10 inch by 14 inch thin flexible aluminum sheet coated with a thin tacky layer of epoxy resin. A particle density of about 25 beads per aquare millimeter was deposited and the epoxy cured to fix the beads permanently in position. Xerox 914 toner was loaded onto the donor by doctoring with a steel blade. The blade was brought into light pressure contact with the bead-studded donor surface. The toner was then corona-charged to minus 150 volts. Donors thus prepared were then brought into self-spacing bead contact with a series of 10 inch square selenium plates bearing 800 volt positive electrostatic latent images thereon. Suppressing voltages of +75 to +150 volts were applied to the donor surfaces. It was observed that developed images of good quality were obtained, whether of the line copy, solid area or half-tone type. Maximum densities of 1.1 to 1.4 were readily attained and the resolution was about 7 line pairs per millimeter.

The image development method of this invention is useful in any electrophotographic reproduction system. The donor shape may be any configuration which permits self-spaced contact with the imaging surface. The imaging surface may be comprised of any material capable of retaining an electrostatic imagewise charge, such as photoconductive insulating materials, dielectrics, and combinations thereof. The electrostatic latent image may be formed directly on the photoconductive material, or by induction on, or transfer to a dielectric film.

The donor surface 13, as explained, is preferably electrically biased during development. Therefore, where this is to be the case, the surface member should be a conductive material or a material capable of supporting such a bias, as a dielectric.

The donor developer material may be any of the commonly known particular powders capable of rendering visible and being attracted to an electrostatic latent image, such as xerographic toners. The toner must be electrically charged opposite the charge comprising the latent image. Toner charging preferably takes place after the toner has been deposited onto the donor.

What is claimed is:

1. In an electrostatographic imaging apparatus, comrising, an imaging member with a surface capable of retaining an electrostatic latent image, a donor member with a surface capable of supporting a layer of particulate image-developing material, and means for maintaining the surface of said donor member in contact with the surface of said imaging member, the improvement comprising a donor member having a relatively incompressible surface permanently disposed thereon and a plurality of raised, granular elements for contacting the imaging member and for self-spacing the donor member surface from the imaging member and wherein said donor member surface is backed by a member that is flexible and compressible whereby said granular elements do not damage said imaging member by pressure from said donor member.

* * * * *